US005266764A

United States Patent [19]

Fox et al.

[11] Patent Number: 5,266,764

[45] Date of Patent: Nov. 30, 1993

[54] FLEXIBLE HEATING HEAD FOR INDUCTION HEATING

[75] Inventors: Robert L. Fox, Hayes; Samuel D. Johnson; Robert H. Coultrip, both of Yorktown; W. Morris Phillips, Newport News, all of Va.

[73] Assignee: The United States of America as represented by the Administrator of the National Aeronautics and Space Administration, Washington, D.C.

[21] Appl. No.: 790,723

[22] Filed: Oct. 31, 1991

[51] Int. Cl.[5] ..... H05B 6/36

[52] U.S. Cl. ..... 219/10.75; 219/9.5; 219/10.77; 219/10.79; 156/272.2; 156/272.4

[58] Field of Search ..... 219/10.493, 10.75, 10.77, 219/10.79, 10.55 M, 9.5; 363/135, 136; 156/272.2, 272.4, 272.6, 82, 94

[56] References Cited

U.S. PATENT DOCUMENTS

| | | | |
|---|---|---|---|
| 1,992,515 | 2/1935 | Uhlmann | 219/10.75 |
| 2,474,977 | 7/1949 | Hart . | |
| 2,667,437 | 1/1954 | Zoubek | 156/272.2 |
| 3,239,403 | 3/1966 | Williams et al. | 156/272.4 |
| 3,403,240 | 9/1968 | Henderson et al. . | |
| 3,404,061 | 10/1968 | Shane et al. | 156/272.2 |
| 3,494,382 | 2/1970 | Shane et al. | 156/272.4 |
| 3,528,867 | 9/1970 | Leatherman et al. | 156/272.2 |
| 3,697,716 | 10/1972 | Kornrumpf | 219/10.491 |
| 3,786,219 | 1/1974 | Kornrumpf et al. | 219/10.77 |
| 3,786,222 | 1/1974 | Harnden et al. | 219/10.75 |
| 3,814,888 | 6/1974 | Bowers et al. | 219/10.77 |
| 3,996,402 | 12/1976 | Sindt | 428/140 |
| 4,144,433 | 3/1979 | Zelahy et al. | 219/9.5 |
| 4,313,777 | 2/1982 | Buckley et al. | 156/272 |
| 4,352,707 | 10/1982 | Wengler et al. | 156/359 |
| 4,490,596 | 12/1984 | Hirai et al. | 219/10.75 |
| 4,521,659 | 6/1985 | Buckley et al. | 219/10.77 |
| 4,529,856 | 7/1985 | Meek et al. | 219/10.55 M |
| 4,532,396 | 7/1985 | Burack et al. | 219/10.493 |
| 4,552,604 | 11/1985 | Green | 156/246 |
| 4,554,036 | 11/1985 | Newsom | 156/94 |
| 4,579,719 | 4/1986 | Keller | 219/10.75 |
| 4,724,020 | 2/1988 | Ebata et al. | 156/82 |
| 4,950,348 | 8/1990 | Larsen | 156/275.3 |
| 5,113,049 | 5/1992 | Border et al. | 219/10.79 |
| 5,128,504 | 7/1992 | McGaffigan et al. | 219/10.43 |

OTHER PUBLICATIONS

M. Berry, "Bonding and nondestructive evaluation of graphite/PEEK composite and titanium adherends with thermoplastic adhesives", SME Technical Paper No. MF85-511, 1985.

J. D. Buckley, et al., "Torod joining gun", SAE Technical Paper Series No. 850408, 1985.

J. D. Buckley et al., "Equipment and techniques for rapid bonding of composites", AS, Metals/Materials Technology Series No. 8521-0005, 1985.

Excerpt from "NASA's Innovators", NASA Tech Briefs, Nov. 1990, p. 12.

K. C. Schmidt letter to John D. Buckley, Union Carbide Corporation, 6 pages 5 Figures, dated Oct. 31, 1986.

Union Carbide Corporation Product Bulleting No. G-201, "GRAFOIL ®", Brand Flexible Graphite, 1986.

B. A. Stein et al., "Rapid adhesive bonding of advanced composites and titanium", AIAA Paper No. 85-07-50-CP, 1985.

M. L. Wilson et al., "Rapid adhesive induction bonding of pultruded aerospace structures", 1988.

J. D. Buckel6, "Carbon-carbon, an overview", Ceramic Bulletin, vol. 67, No. 2, 1988, pp. 364-368.

*Primary Examiner*—Bruce A. Reynolds
*Assistant Examiner*—Tu Hoang
*Attorney, Agent, or Firm*—Kevin B. Osborne; Kimberly A. Chasteen

[57] ABSTRACT

An induction heating head includes a length of wire having first and second opposite ends and being wound in a flat spiral shape to form an induction coil, a capacitor connected to the first and second ends of the wire, the induction coil and capacitor defining a tank circuit, and a flexible, elastomeric body molded to encase the induction coil. When a susceptor is placed in juxtaposition to the body, and the tank circuit is powered, the susceptor is inductively heated.

6 Claims, 3 Drawing Sheets

FLEXIBLE HEATING HEAD FOR INDUCTION HEATING

CROSS-REFERENCE TO RELATED PATENTS

This application is related to co-pending applications, Ser. No. 07/944,607, filed Sep. 14, 1992 and Ser. No. 07/790,731, filed Oct. 31, 1991.

ORIGIN OF THE INVENTION

The invention described herein was jointly made by an employee of the U.S. Government and employees of the Inductron Corporation and may be manufactured and used by or for the Government for governmental purposes without the payment of any royalties thereon or therefor.

BACKGROUND OF THE INVENTION

1. Field of the Invention

The present invention relates generally to electromagnetic heating devices and, more specifically, to a heating head capable of heating a relatively large zone, particularly on curved surfaces.

2. Description of the Related Art

There currently exists a wide number and variety of induction heating devices. One such induction heating device is described in U.S. Pat. No. 4,521,659, issued to Buckley et al. on Jun. 4, 1985. The heating gun described therein uses a tank circuit which includes a capacitor and an inductor coil. The inductor coil is wrapped around a U-shaped pole piece which has a gap formed between the ends thereof. The capacitor of the tank circuit is connected to a power supply which provides an alternating current of predetermined frequency.

The aforementioned patent describes a technique of joining two sheets of material by placing a susceptor, such as a wire screen, between the sheets with adhesive therebetween. The heating gun is positioned above the two sheets and the screen with the ends of the pole piece touching one of the sheets and with a gap of the pole piece located above the area where the sheets are to be joined. An alternating current from the power source enters the tank circuit and the capacitor increases the Q of the tank circuit, in turn increasing the current flow through the inductor coil. Direction of the current along the inductor coil reverses at each cycle of alternating current. The current flow in the inductor coil creates a magnetic flux within the turns of the coil. The flux is picked up by the pole piece and carried to either of the two ends. The flux then jumps to the susceptor rather than across the gap to the other of the two ends. Since the sheets of material are transparent to magnetic flux, the flux is easily transferred to the screen through the sheets. The rapidly changing direction of current in the coil causes the flux to change constantly in magnitude and direction. This is also true in the metal screen as well as in the pole piece. Hysteresis creates eddy currents in the screen which result in heat being generated in the screen.

While the aforementioned heating gun is suitable for laying down a single heat zone, whereby a seam can be created between two pieces of layered material, particularly for flat surfaces, it is sometimes desirable to heat curved surfaces to form multi-ply composites.

Prior methods have employed induction heating of high reluctance metal screens or perforated metal sheets sandwiched between two pieces of thermoplastic or screen susceptors or metal sheet susceptors encapsulated with adhesives sandwiched between non-thermoplastic adherences. These methods generally require the use of a susceptor in the bondline which, in some bonding processes, is considered unacceptable because of possible corrosion or galvanic action. With conductive susceptors, it is difficult to use conventional non-destructive evaluation of joints and seam welds or bonds. In the past, electric heat blankets have been used to process adhesives in bondlines. Heat blankets are limited to process temperatures of about 450° F., however.

Additionally, the use of induction heating devices for patch repair of damaged aircraft structures, such as wind screens, wing surfaces, etc., normally require vacuum bagging. Vacuum bagging assures proper pressure between patches and the damaged surface area while maintaining patch stability during the bonding process. Typically, vacuum bagging removes excessive air from the bondline/adhesive resulting in a higher strength repair.

Vacuum bagging typically includes applying a ring or layer of sealant, vacuum tape, to surfaces being repaired. A suction end of a vacuum hose is positioned inside the sealant ring and held in place by additional sealant at the point where the hose crosses the sealant ring. A layer of material such as Kypton film is placed over and in contact with the sealant ring. A vacuum is created in the patch area when suction is applied to the vacuum hose. In conventional vacuum bagging, as described above, the process is time consuming and requires a variety of materials. Moreover, it is extremely difficult where overhead patches are required or when working in harsh weather conditions.

The heating head itself is an important consideration. Previous induction heating devices utilize heating heads with rigid coil core material for focusing the heat-generating flux to a specific area. This is unacceptable when trying to apply the heat to a curved surface since the core material would prevent the coil from conforming to the shape of the surface. Since the flux transferred from the coil to any point on the susceptor is a function of the distance between that point and the coil, uneven heating of the surface will result.

SUMMARY OF THE INVENTION

An object of the present invention is therefore to provide a flexible heating head for use in induction heating devices and methods, which is lightweight, portable, and simple to use.

Another object of the present invention is to provide a flexible heating head for use in an induction heating device in which the heat generated by the head can be reliably and effectively distributed under all weather conditions, on curved surfaces as well as flat surfaces.

These and other objects of the invention are met by providing an induction heating head which includes a length of wire having first and second opposite ends and being wound in a flat spiral shape to form an induction coil, a capacitor connected to the first and second ends of the wire, the induction coil and capacitor defining a tank circuit, and a flexible, elastomeric body molded to encase the induction coil. When a susceptor is placed in juxtaposition to the body, and the tank circuit is powered, the susceptor is inductively heated.

DETAILED DESCRIPTION OF THE PREFERRED EMBODIMENTS

Figure 1:
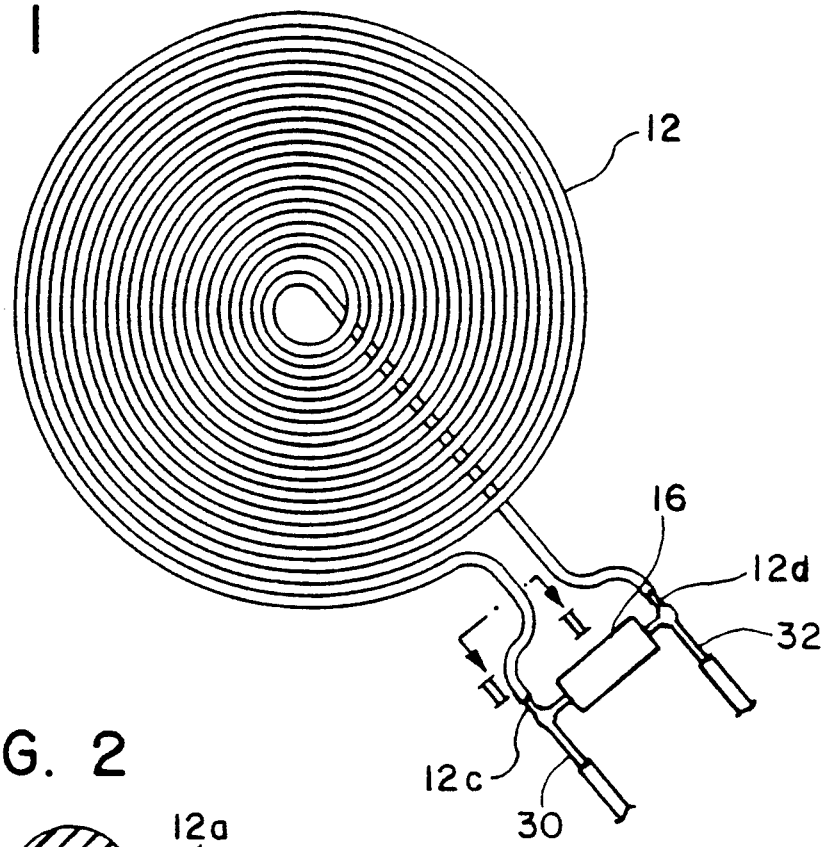
FIG. 1 is a top view of an induction coil and capacitor, which comprises a tank circuit, according to the present invention.
Figure 2:
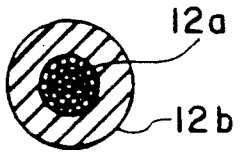
FIG. 2 is a section view taken along line 11—11 of FIG. 1.
Figure 3:
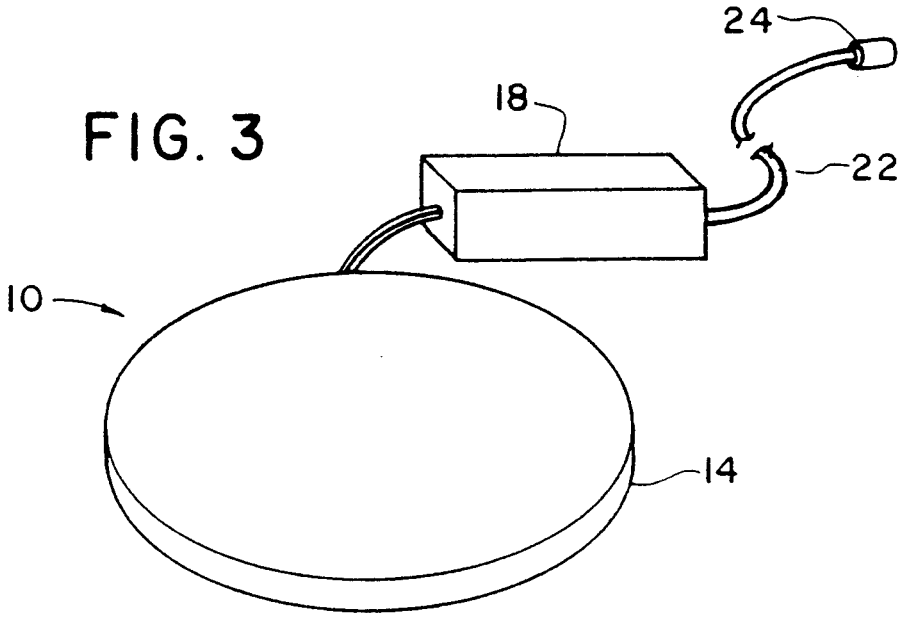
FIG. 3 is perspective view of an induction heating head according to the present invention.
Figure 4:
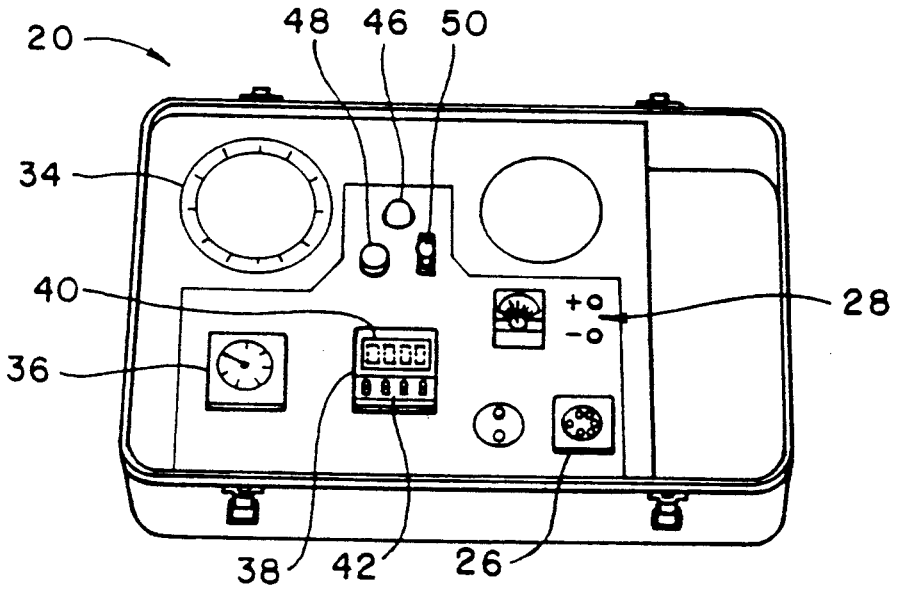
FIG. 4 is a perspective view of a power supply unit of the present invention, used in conjunction with the heating head of FIG. 3.

Referring to FIGS. 1-3, a flexible heating head according to the present invention is generally referred to by the numeral 10 and includes an inductive coil 12 embedded in a high temperature resistance elastomeric, flexible body 14 which is molded into the shape of a disk. The coil 12 illustrated in FIG. 1 is shown prior to molding and may consist of, for example, a length of insulated wire wound in an involute spiral to form a plurality of equidistantly spaced, concentric windings which are held by a suitable jig (not shown), or other means during molding so that center axes of the winding are mutually coplanar. The wire, as shown in FIG. 1 (*a*), has preferably a multi-stranded copper core 12*a* in an insulative sheath 12*b*. One example of a commercially available wire is CAROL SUPER VU-TRON II 600 V electric cable, which is particularly suitable for the purposes of the present invention because of the ease with which a piece of this wire bends and flexes, without retaining the bent shape. As a further example, twelve feet of such wire when coiled will form a circle of about a nine inch diameter.

The coil 12 is completely encapsulated in the body 14 by any conventional means of molding. The elastomeric material which forms the body 14 can be any of a variety of known materials which can be applied to a mold in liquid form and then after setting forms a solid material which is flexible and resilient. The material thus provides a high temperature coating which protects the windings from heat generated during induction heating and which holds the windings in their pre-casting positions illustrated in FIG. 1. An example of a commercially available plastic material suitable for use in forming the body 14 is RTV 60.

When the body 14 is placed on an uneven surface, the body 14 can be pressed by hand to conform to the shape of the uneven surface. This allows the windings within the body 14 to remain at an equal distance from the surface.

The two opposite ends 12*c* and 12*d* of the length of wire which forms the coil 12 extend out of the side of the body 14 and are connected to a capacitor 16 (or plural capacitors connected in parallel). The capacitor 16 and the induction coil 12 thus form a tank circuit. Preferably, the capacitor is mounted in a housing 18 and the tank circuit is energized via a power source which is incorporated into a portable control unit 20. The control unit 20 is connected to the tank circuit through a power cord 22 having a coupler 24 that plugs into a socket 26 of the control unit 20. The control unit may be provided with AC or DC current derived from any convenient source, such as household current or a D.C. battery connected at input jacks 28.

The control unit 20 includes a self-timing solid state power oscillator which produces a $KH_z$ output which is delivered to the capacitor via power lines 30 and 32 which run through the power cord 22. The frequency of the power output can be varied by turning a power output control knob 34 of the control unit 20 to achieve a desired power with a 0.47 $M_f$800 VDC (SPRAGUE Model 710P) capacitor. The power output of the oscillator at 2000 watts can reach about 25 KHz.

The heating head of the present invention can also use the power source described in U.S. Pat. No. 4,521,659, which is incorporated herein by reference.

The alternating current supplied to the tank circuit and passing through the coil produces a magnetic flux inside and around the induction coil 12. The flux jumps to a susceptor if placed in juxtaposition to the induction coil 12. Hysteresis creates eddy currents in the susceptor which result in heat generated in the susceptor.

The heat generated by the heating head facilitates the curing of large adhesive bond areas in a single operation. Moreover, since the heating head is flexible, it can conform to complex, curved surfaces common to aircraft structures, thereby assuring even curing of adhesive bonding repairs of windscreens, wing surfaces, etc.

The control unit 20 may include a timer 36 which can be set so that induction heating can occur for a predetermined length of time. Also, the control unit 20 may include a temperature controller 38 which has a digital read out 40 consisting of a four digit number read out. A push button 42 is provided for each digit so that a predetermined temperature can be selected and input into the control unit 20. The temperature controller 38 is used in conjunction with a thermocouple provided at the area to be heated so that the thermocouple leads are connected to the control unit at the thermocouple jack 44. The control unit 20 includes internal circuitry which includes a microprocessor so that the sensed temperature value can be compared to the input temperature provided at the temperature controller 38. For example, the controller can be programmed so that once the predetermined temperature is achieved, the controller will maintain the predetermined temperature for a predetermined period of time. Thus, the maximum temperature can be preset by means of the temperature controller 38. This is particularly advantageous for curing adhesives which specify a predetermined temperature level for a predetermined period of time in order to effect a cure of the adhesive.

Other aspects of the control unit include a power on light 46, a fuse 48 and a power on/off toggle switch 50. The temperature controller is commercially available from OMEGA and can be suitably wired into the power circuit so that the power output is controlled to maintain the predetermined temperature. Similarly, timers are commercially available and can be suitably wired to the power circuit so that the power is automatically cut-off to the tank circuit after expiration of the predetermined period of time.

Figure 5:
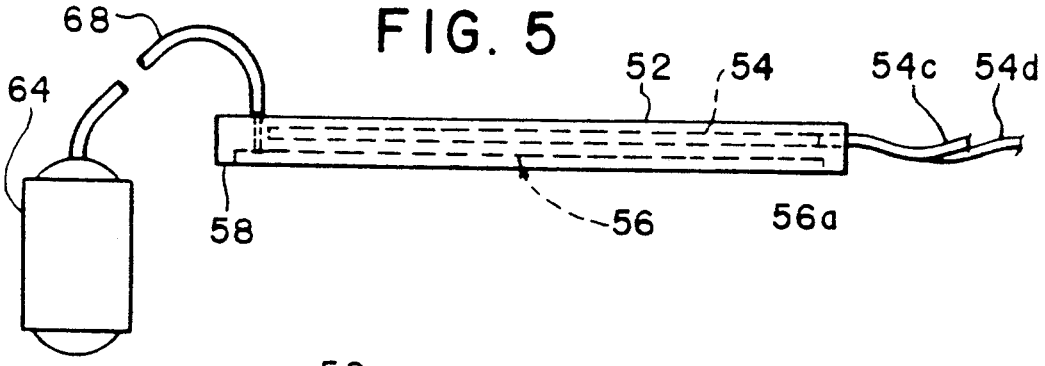
FIG. 5 is a side elevational view of a second embodiment of a heating head (without illustrating the capacitor) according to a second embodiment of the present invention.

Another embodiment of the present invention is illustrated in FIG. 5, in which the disk-shaped body 52 is similarly molded to envelope a coil 54 having opposite ends 54*c* and 54*d* which extend out a side thereof for connection to a capacitor (or capacitors). In the embodiment of FIG. 5, the overall diameter of the disk-shaped body 52 is made slightly larger such that, for example, if the coil 54 has a diameter of about 9 inches, the overall diameter of the body 52 will be about 11 inches, to provide an additional inch around the periphery of the disk. A circular recess 56 is then formed in the surface of the body 52 which will overlay objects to be heated. The circular recess 56 defines an annular flange 58 extending circumferentially around the body 52. When the body is placed on a surface to be worked, a suction chamber 60 is defined between the surface 62 to be worked and the surfaces of the recess 56. These surfaces include a flat, circular surface 56*a* and a cylindrical surface 56*b*.

Once the body 52 is placed on the surface to be worked, a vacuum pump 64 is activated to remove air from the chamber 60 thus creating a vacuum which draws the flexible body 52 downwardly onto whatever is placed in the chamber that requires heating, such as an adhesive material which is used to attach a patch or other adherend to the underlying surface 62. The vacuum is introduced to the chamber 60 through a fitting 66 which is mounted in a hole formed through the body 52. The fitting can be of any suitable type to which a vacuum hose 68 of the vacuum pump 64 can be attached. In the embodiment illustrated, the fitting 66 includes a threaded stem 68, a nut 70 and washers 72 and 74. Air is removed from the chamber 60 through a central bore 76 of the stem 68.

In the illustrated embodiment, the heating head weights approximately two pounds, and is thus advantageous as a light weight, easy to use device. This is based on the nine inch diameter induction coil which is encapsulated in a body having a diameter of about eleven inches and a thickness of about one half inch. The body is molded to encapsulate the coil and is made of the aforementioned high temperature, highly flexible plastic material, such as RTV 60. The flange of the annular step is about one quarter of an inch around the outer perimeter and thus provides the peripheral seal for the suction chamber. With suction applied to the vacuum fitting, and the head positioned over a patch on a surface to be repaired, the quarter inch shoulder or step around the heating head contacts the surface being repaired and a vacuum seal results. The vacuum pulls the nine inch heating area of the head against the patch to assure good patch/adhesive to surface pressure and removes excessive air from the adhesive. This also permits holding of the heating head in proper position for the duration of the repair process.

In most cases surfaces requiring repairs or patches are smooth enough so that with suction applied to the heating head and with the quarter inch shoulder of the heating head in contact with the surface being repaired, a vacuum seal will result and be maintained. A thin coating of commercial vacuum grease applied to the face of the heating head shoulder may be used to supplement the vacuum seal. In cases where surfaces to be repaired are unusually rough, or where rivet/screwheads obstruct good heating head to surface contact, a layer of sealant tape can be applied to the heating head shoulder to assure proper seal.

Figure 8:
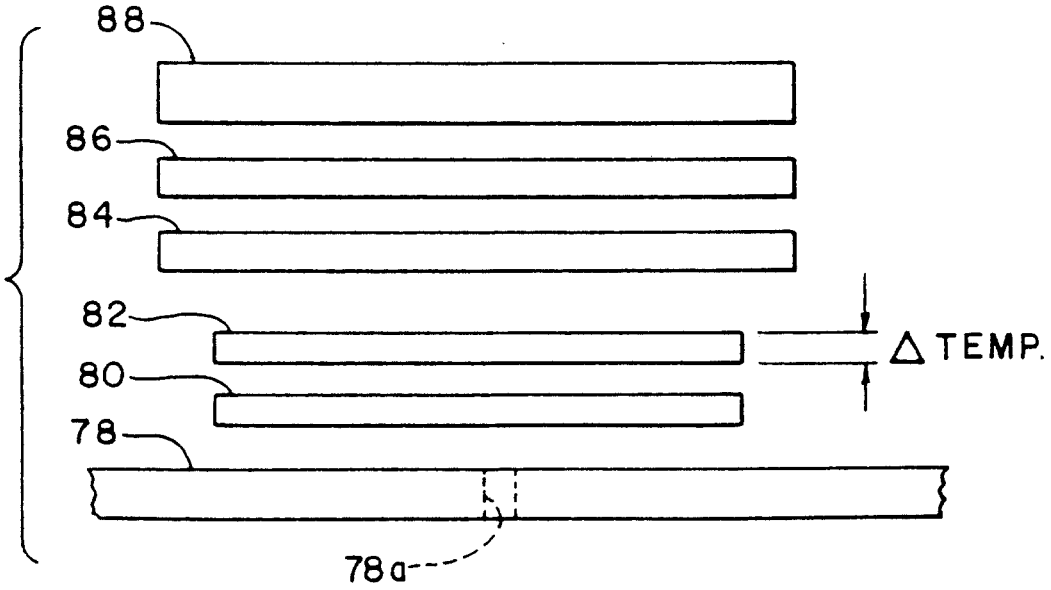
FIG. 8 is a schematic, exploded view showing a method of induction heating according to the present invention.

Referring to FIG. 8, a patching technique using the heating head of the present invention is illustrated aschematically. A first adherend 78 has some need of repair, which is illustrated as a hole 78*a* which requires patching. First, an adhesive strip 80 is placed on the surface of the adherend 78 over the hole 78*a*. The adhesive may be of the type which is thermoplastic and/or thermosetting and is cut to fit from a sheet. A suitable type of adhesive which is commercially available is known as PEEK, which is a trademark for the ICI Corporation and is essentially a poly(phenylene ether ether) ketone. Prior to heating, the PEEK sheet is a flexible, solid sheet which is essentially transparent. At about 720° F., the sheet melts and is thus thermoplastic. It eventually cures to form a strong bond between the adherend 78 and a superimposed adherend 82.

As mentioned above, FIG. 8 is schematic, and the dimensions of the various materials are exaggerated for the purposes of illustration. Typically, a sheet of PEEK has a thickness of less than a millimeter and thus exaggerated thicknesses are required for a better understanding of the laminated structures created by induction heating.

A second adherend 82 is, generally speaking, the patch which covers the hole 78. The adhesive 80 is thus required to bond the adherend 82 to the adherend 78.

Prior methods of induction heating have used metal screens or perforated metal sheets sandwiched between two pieces of thermoplastic in order to generate the required induction heating. Also, thermoplastics have been used in the past that have conductive particles formed therein to provide particle-susceptors for joining plastics, ceramics, and composites. These techniques all require a susceptor in the bondline which in some bonding processes is considered unacceptable because of possible corrosion or galvanic action.

According to the present invention, a flexible ceramic susceptor 84 is used outside the bondline in order to join metals, plastics and ceramics using thermoset/thermoplastic adhesives. Prior uses of metallic susceptors in the bondline region creates a problem of unacceptable bond line thickness or other problems, such as a radar signature which is generated by virtue of having the metallic susceptor becoming part of the composite structure.

This problem is overcome by using a flexible susceptor 84 which can be as thin as 0.0005 inches. A suitable flexible ceramic material is known as GRAFOIL which is a product of Union Carbide. Basically, the susceptor 84 is heated by induction heating and the heat is transferred through the adherend 82 to the adhesive 80, thus causing the adhesive to melt thermoplastics or cure thermosetting adhesives. Temperature controllers as described herein can be used as a means of controlling the bondline temperature.

Figure 6:
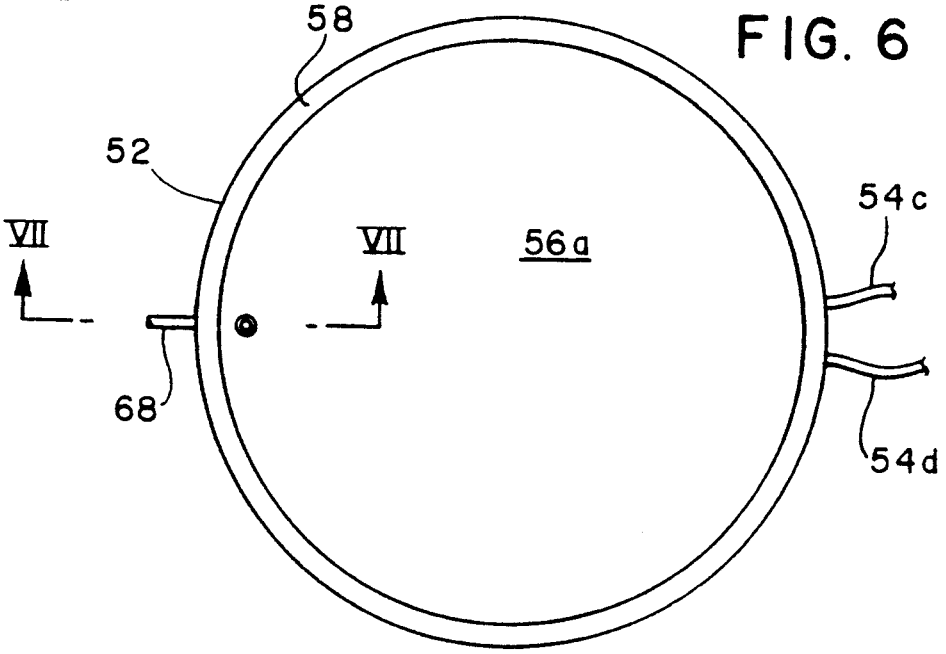
FIG. 6 is a bottom view of the induction heating head of FIG. 5.
Figure 7:
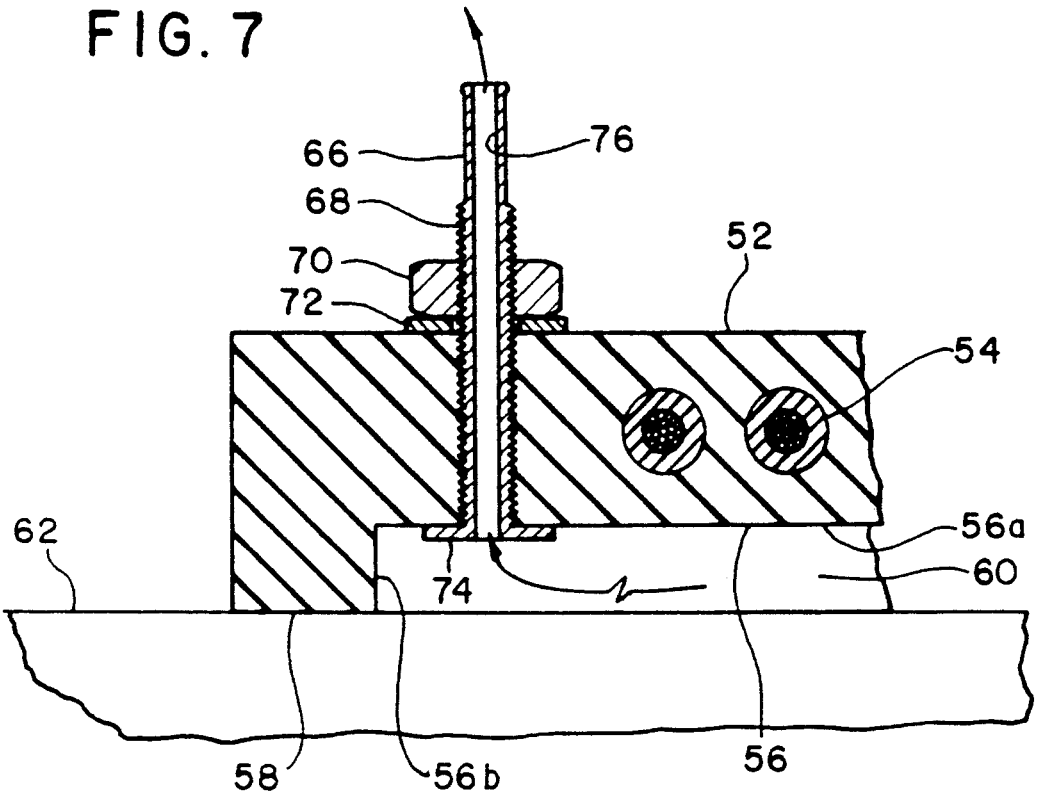
FIG. 7 is an enlarged, sectional view taken along line VII—VII of FIG. 6.

The vacuum techniques described with respect to the embodiment of FIG. 5 can be employed to cure the adhesive 80 using a GRAFOIL susceptor 84. Other susceptors may be employed to heat the adhesive 80 through the adherend 82, but preferably, the susceptor is extremely thin yet of sufficiently high reluctance so as to be heated by induction heating of the heating head 88 (which may correspond to the heating heads 14 or 52 of the embodiments described herein) to facilitate a rapid heat transfer to the adherend 82. Vacuum bagging may also be used in conjunction with the flexible heating head of FIG. 3 to ensure pressure at the bondline, to eliminate fixturing during cure and to remove volatiles or trapped air during adhesive curing. This will result in higher bond strengths and significant cost savings. The same advantages can be achieved by using the embodiment of FIG. 6 instead of using vacuum bagging.

Since the flexible heating head 88 and the GRAFOIL susceptor 84 are both flexible, the method of the present invention can be used to repair or manufacture complex, curved structures. The present technique produces temperatures up to 1300° F. in less than 15 seconds, using a 2,000 watt power unit to power a nine inch diameter induction coil. The temperatures which are capable of being achieved by induction heating are generally three times higher than that which can be achieved by using heat blankets. Moreover, using a susceptor outside of the bondline produces a thinner bondline which can be heated more quickly and more evenly than previously possible.

Preferably, an insulative layer 86 is provided between the heating head 88 and the GRAFOIL susceptor 84. Also, the bondline temperature, at the adhesive layer 80, is less than that of the susceptor 84 because of heat transfer properties of the adherend 82. Thus, the insulation layer 86 is used to prevent the induction heating head 88 from heat sinking the GRAFOIL susceptor 84.

Either of the adherends 78 and 82 can be metallic, plastic, or ceramic. The chosen materials should permit a relatively heat transfer through the adherend 82 to the underlying adhesive layer 80. It is also possible to apply multiple layers of adhesive layer 80 and adherend 82 so as to provide a multi-ply laminated structure. This is normally the case for patches which require a great deal of strength. One such known technique is to use "pyramid" patches whereby the lowermost plies are of greater diameter than the uppermost plies in a gradually decreasing manner from bottom to top so as to create a "pyramid" type structure. This is particularly suitable for aerodynamic structures since it creates a better contour for aerodynamic purposes.

Numerous modifications and adaptations of the present invention will be apparent to those so skilled in the art and thus, it is intended by the following claims to cover all such modifications and adaptations which fall within the true spirit and scope of the invention.

We claim:

1. An induction heating head comprising:

a length of wire having first and second opposite ends and being wound in a flat spiral shape to form an induction coil;

a capacitor connected to the first and second ends of the wire, the induction coil and capacitor defining a tank circuit; and a flexible, elastomeric body molded to encase the induction coil, wherein the body has first and second parallel surfaces and a cylindrical sidewall, wherein the first parallel surface is circumscribed by an annular rim, and a passage extends through the body from the first parallel surface to the second parallel surface, the passage being adapted to connect to a vacuum pump means for creating a vacuum in a chamber defined by the first parallel surface, an underlying work surface, and an interior surface of the annular rim.

2. An induction heating head according to claim 1, wherein the induction coil includes a plurality of parallel, coplanar windings.

3. An induction heating head according to claim 1, wherein the wire has a multi-stranded core surrounded by an insulating sheath.

4. An induction heating device comprising:

a power supply;

a tank circuit including a capacitor and an induction coil and being connected to the power supply to receive a high frequency alternating drive current wherein the induction coil is a length of wire having first and second opposite ends;

a flexible plastic body encapsulating the induction coil, wherein the body has first and second parallel surfaces and a cylindrical sidewall, the first parallel surface is circumscribed by an annular rim, and a passage extends through the body from the first parallel surface to the second parallel surface; and vacuum pump means, connected to the passage, for creating a vacuum in a chamber defined by the first parallel surface, an underlying work surface, and an interior surface of the annular rim.

5. An induction heating head according to claim 4, wherein the induction coil includes a plurality of parallel, coplanar windings.

6. An induction heating head according to claim 4, wherein the wire has a multi-stranded core surrounded by an insulating sheath.

* * * * *